US010513952B2

(12) United States Patent
Weidinger et al.

(10) Patent No.: US 10,513,952 B2
(45) Date of Patent: Dec. 24, 2019

(54) EXHAUST VALVE DEACTIVATION

(71) Applicant: Bayerische Motoren Werke Aktiengesellschaft, Munich (DE)

(72) Inventors: Ferdinand Weidinger, Geretsried (DE); Alexander Hiereth, Munich (DE); Timo Klees, Hebertshausen (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 15/889,809

(22) Filed: Feb. 6, 2018

(65) Prior Publication Data

US 2018/0163583 A1 Jun. 14, 2018

Related U.S. Application Data

(63) Continuation of application No. PCT/EP2016/073888, filed on Oct. 6, 2016.

(30) Foreign Application Priority Data

Oct. 14, 2015 (DE) ..... 10 2015 219 876

(51) Int. Cl.
*F01L 1/34* (2006.01)
*F01L 13/00* (2006.01)
(Continued)

(52) U.S. Cl.
CPC ..... *F01L 13/0036* (2013.01); *F01L 1/047* (2013.01); *F01L 1/185* (2013.01);
(Continued)

(58) Field of Classification Search
CPC ..... F01L 13/0036; F01L 1/047; F01L 1/185; F01L 2001/0473; F01L 2013/0052; F01L 2013/101
See application file for complete search history.

(56) References Cited

U.S. PATENT DOCUMENTS

2010/0108006 A1* 5/2010 Elendt ..... F01L 1/047 123/90.17
2010/0199935 A1 8/2010 Lengfeld et al.
(Continued)

FOREIGN PATENT DOCUMENTS

CN 102383891 A 3/2012
DE 10 2004 056 290 A1 6/2006
(Continued)

OTHER PUBLICATIONS

International Search Report (PCT/ISA/210) issued in PCT Application No. PCT/EP2016/073888 dated Feb. 8, 2017 with English translation (eight pages).
(Continued)

*Primary Examiner* — Zelalem Eshete
(74) *Attorney, Agent, or Firm* — Crowell & Moring LLP

(57) ABSTRACT

A valve control of an internal combustion engine has a camshaft and a cam sleeve, which surrounds the camshaft and is fastened in an axially movable manner and has cams, which are associated with individual valves and extend in the radial direction. The cam sleeve can be moved in the axial direction in relation to the camshaft by an actuator during rotation. The cam sleeve has at least two axial segments, which can be moved in relation to each other in the axial direction by the actuator, which engages in the axial segments.

20 Claims, 2 Drawing Sheets

(51) Int. Cl.
*F01L 1/047* (2006.01)
*F01L 1/18* (2006.01)

(52) U.S. Cl.
CPC ..... *F01L 2001/0473* (2013.01); *F01L 2013/0052* (2013.01); *F01L 2013/101* (2013.01)

(56) References Cited

U.S. PATENT DOCUMENTS

| | | | |
|---|---|---|---|
| 2010/0199945 | A1 | 8/2010 | Meintschel et al. |
| 2010/0288217 | A1 | 11/2010 | Stolk et al. |
| 2012/0048219 | A1 | 3/2012 | Choi et al. |
| 2013/0306014 | A1 | 11/2013 | Stolk et al. |

FOREIGN PATENT DOCUMENTS

| | | | |
|---|---|---|---|
| DE | 10 2007 037 747 | A1 | 2/2009 |
| DE | 10 2007 042 932 | A1 | 3/2009 |
| DE | 10 2007 056 692 | A1 | 5/2009 |
| DE | 10 2007 062 234 | A1 | 6/2009 |
| DE | 10 2008 005 639 | A1 | 7/2009 |
| DE | 10 2011 011 456 | A1 | 8/2012 |
| DE | 10 2012 105 795 | A1 | 1/2014 |
| DE | 10 2013 019 260 | A1 | 5/2015 |
| DE | 10 2014 223 580 | A1 | 5/2015 |
| DE | 10 2014 221 136 | B3 | 3/2016 |
| JP | 2015-513635 | A | 5/2015 |
| WO | WO 2010/115399 | A1 | 10/2010 |

OTHER PUBLICATIONS

German-language Written Opinion (PCT/ISA/237) issued in PCT Application No. PCT/EP2016/073888 dated Feb. 8, 2017 (seven pages).

German-language Search Report issued in counterpart German Application No. 10 2015 219 876.6 dated Aug. 18, 2016 with partial English translation (11 pages).

Chinese-language Office Action issued in counterpart Chinese Application No. 201680036324.8 dated May 15, 2019 with English translation (15 pages).

* cited by examiner

EXHAUST VALVE DEACTIVATION

CROSS REFERENCE TO RELATED APPLICATIONS

This application is a continuation of PCT International Application No. PCT/EP2016/073888, filed Oct. 6, 2016, which claims priority under 35 U.S.C. § 119 from German Patent Application No. 10 2015 219 876.6, filed Oct. 14, 2015, the entire disclosures of which are herein expressly incorporated by reference.

BACKGROUND AND SUMMARY OF THE INVENTION

The invention relates to a valve control of an internal combustion engine having a camshaft and a cam sleeve which is displaceably arranged on the camshaft, on which the cams for the valve displacement are formed.

In particular, the valve control serves for the exhaust valve deactivation as a part of the control for the cylinder deactivation in internal combustion engines for lowering the fuel consumption. By deactivating the inlet and exhaust valves combined with an interruption of the fuel supply half of the cylinders are deactivated and thus the operating point of the engine, because of the mean pressure increase, is displaced into a range of better efficiency.

In addition to mechanical solutions with more than one crankshaft, solutions for the cylinder deactivation are also known from the prior art, for example in which rotation the fuel injection and mixture ignition are enabled or shut-off in a controlled manner.

In addition, a cam sleeve that can be displaced on the camshaft via an actuator is already known from the prior art. However, because of the different control times of individual cylinders and the displacement of the cams on the camshaft in circumferential direction, a separate actuator and a separate cam sleeve have had to be employed for each cylinder up to now. In terms of control, this is complicated, susceptible to error and expensive because of the high number of components.

Building on what is known, the invention is based on the object of providing a valve control for an exhaust valve deactivation with which the valves of a plurality of cylinders can be simultaneously controlled and thus the associated cylinders can be activated or deactivated.

This and other objects are achieved according to the invention by a valve control of an internal combustion engine having a camshaft and a cam sleeve which surrounds the camshaft and is fastened in an axially displaceable manner. The cam sleeve has cams associated with individual valves and extending in the radial direction, wherein the cam sleeve during rotation is displaceable relative to the camshaft in the axial direction by an actuator. The cam sleeve comprises at least two axial sections, which are displaceable relative to one another in the axial direction via the actuator engaging in the axial sections.

The cam sleeve is provided on the region of the camshaft in which the cylinders are to be deactivated. In the case of a six-cylinder in-line engine, according to the invention a cam sleeve is arranged on the camshaft for three adjacent cylinders, in order to switch the camshaft to active or inactive via the displaceable cam sleeve for the three cylinders. Since the cams in the region of the camshaft with cam sleeve are not provided on the camshaft itself but on the cam sleeve, an axial displacement of the cam sleeve away from the valves results in that the cams do not act on the valves but, axially spaced therefrom, rotate past the valves. For activating the valve displacement via the cams, the cam sleeve is again displaced into the original position in the axial direction. On the further three cylinders the camshaft comprises its conventional cams so that on these cylinders a valve displacement always takes place and thus only three of the six cylinders can be deactivated.

Compared with the prior art, the invention is characterized in that the cam sleeve is formed in multiple parts and is thus suitable to realize a deactivation of valves on a plurality of cylinders with only one actuator.

In one embodiment, the valve control according to the invention is provided such that the at least two axial sections of the cam sleeve are displaceable relative to one another in the axial direction during the engagement of the actuator by rotation of the cam sleeve. Because of the fastening of the cam sleeve on the camshaft, the camshaft and cam sleeve rotate coaxially with one another. The two axial sections make it possible during the rotation of the camshaft with cam sleeve to initially move a cam sleeve section of a first cylinder axially and thus deactivate the valve displacement of this cylinder. At that time, the cams of the cam sleeve still act on the associated valves on the adjacent cylinders so that a displacement of the cam sleeve in the region of these cylinders is still impossible. The continuing rotation brings the cams of the cam sleeve on the further cylinders into a position that is disengaged from the valves so that, subsequently, an axial displacement of the second axial section of the cam sleeve is possible.

The valve control is therefore characterized in that during the rotation of the cam sleeve over a predetermined angle, in particular 180°, by the actuator, the first axial section is initially displaced in an axial direction and upon a continuation of the rotation over a further predetermined angle, in particular further 180°, the second axial section is subsequently displaced in the same axial direction until the first and second axial sections of the cam sleeve at the cylinders to be deactivated, axially displaced, again lie against one another. When both axial sections, following a 360° rotation of the camshaft, have been axially displaced, the cams of the cam sleeve no longer act on the valves and the cylinders are deactivated.

To achieve the axial displacement of the axial sections of the cam sleeve, it is provided, in an embodiment, that in an outer circumferential surface of the two axial sections of the cam sleeve at least two sliding grooves extending in the circumferential direction and the axial direction run in each case, in which the actuator engages. The sliding grooves of the axial sections merge into one another at a transitional position of the axial sections. The transitional position is determined by the axial relative position of the axial sections on the camshaft relative to one another.

An embodiment, in which the actuator comprises at least one first actuator pin, which engages in the first sliding groove of the axial sections of the cam sleeve and consecutively displaces the axial sections in a first axial direction upon the rotation of the cam sleeve described above, is advantageous. In addition, an embodiment is advantageous in which the actuator comprises at least one second actuator pin, which engages in the second sliding groove of the axial sections of the cam sleeve and consecutively displaces the axial sections in a second axial direction upon a counter-rotation of the cam sleeve. With such an embodiment, the actuator engages with, in each case, one actuator pin in a respective sliding groove. The engagement in the first sliding groove serves for an axial displacement in a first direction and the engagement in the second sliding groove serves for a resetting into the original axial position.

On the actuator, the actuator pins are arranged fixed in position so that the axial sections are displaced in the axial direction relative to the actuator while the actuator pins during the rotation of the cam sleeve slide in the sliding grooves. The actuator itself is likewise fixed in position.

In a development of the invention, it is further provided that the sliding grooves have a tapering cross section with oblique radial contact surfaces, against which the actuator pins lie in a flat manner. Here, the radial contact surfaces mainly extend at the same angle as the actuator pins so that they engage in the sliding grooves without play. Because of this, load peaks during the switching process, and thus wear on the actuator pins and sliding grooves, are avoided.

In another embodiment of the invention, the camshaft has an axial end stop which delimits the axial moveability of the at least two axial sections. In an advantageous exemplary embodiment, the axial end stop is formed by retaining devices, for example locking balls, arranged between the camshaft and the at least two axial sections and preloaded in the radial direction. The retaining devices in each case releasably engage in inner grooves provided on radial inner surfaces of the at least two axial sections. Because of this, sliding of the cam sleeve off the camshaft is prevented. In addition, fastening of the cam sleeve on the camshaft is preferentially effected via splines.

Other objects, advantages and novel features of the present invention will become apparent from the following detailed description of one or more preferred embodiments when considered in conjunction with the accompanying drawings.

BRIEF DESCRIPTION OF THE DRAWINGS

The same reference characters denote the same parts in all views.

DETAILED DESCRIPTION OF THE DRAWINGS

Figure 1:
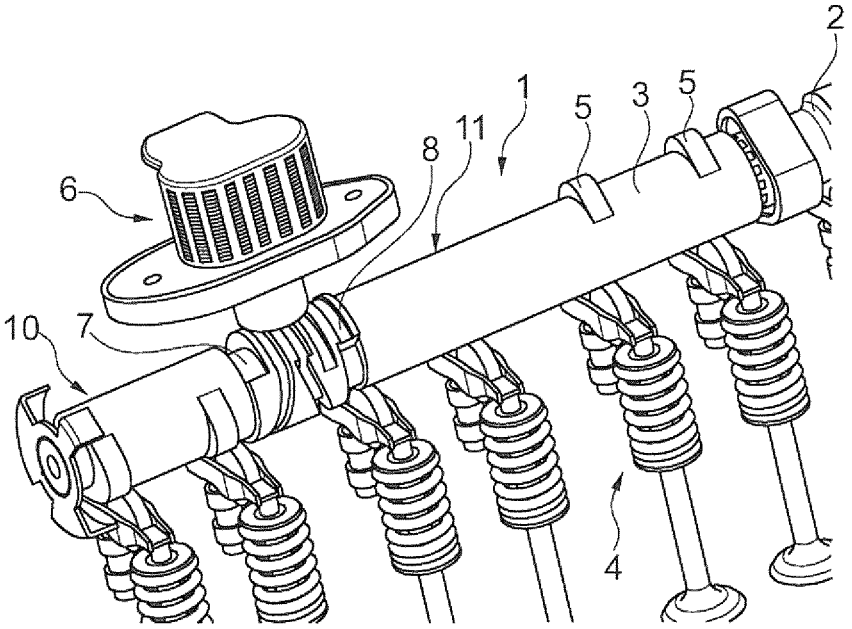
FIG. 1 is a perspective view of the valve control on three cylinders to be deactivated.
Figure 2:
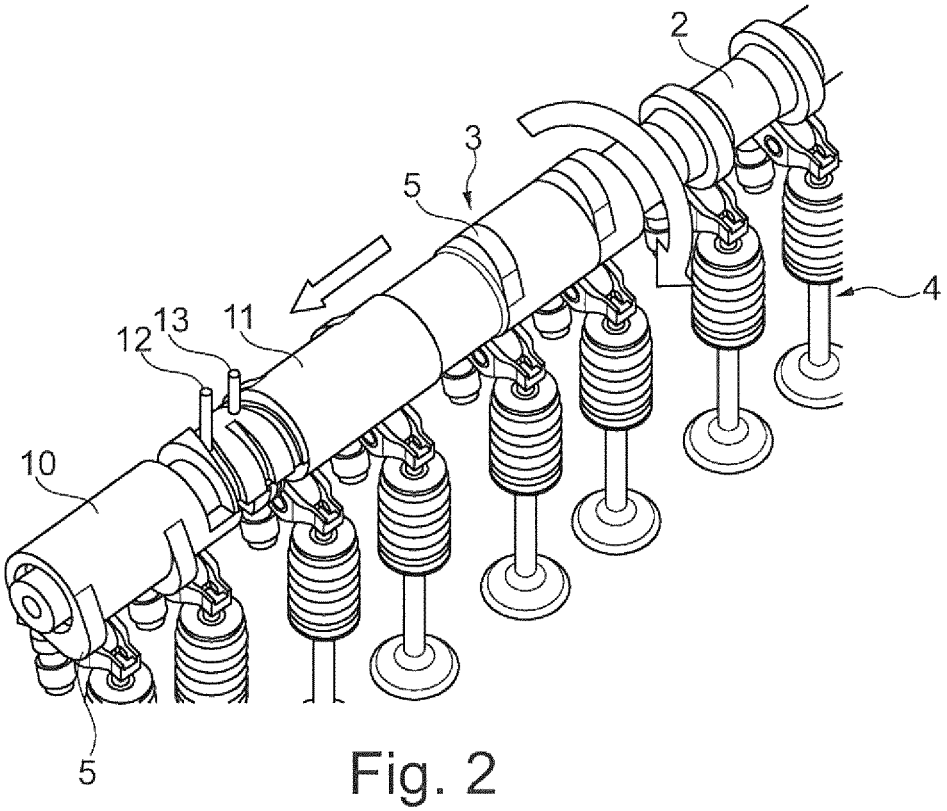
FIG. 2 is a perspective representation of the cam sleeve with axially displaced first axial section.

FIGS. 1 and 2 show an exemplary embodiment of the valve control 1 of a six-cylinder in-line engine on the exhaust valve side, wherein for each cylinder two valves 4 are provided. On the camshaft 2 a cam sleeve 3 is coaxially arranged and fastened for the cylinders 1-3 located axially outside, so that camshaft 2 and cam sleeve 3 rotate together. In the region of the cam sleeve 3, the cams 5 are formed on the cam sleeve 3 in the axially following region without cylinder deactivation as conventionally formed on the camshaft 2. The cam sleeve 3 is formed in two parts with two axial sections 10, 11, each of which are axially displaceable so that the cams 5 are in engagement with the valves 4 in a cylinder-active position, and in a cylinder-deactivated position are axially displaced so as to rotate past the valves 4 without effect.

The axial displacement is controlled via the actuator 6 which, via two actuator pins 12, 13, engages in two sliding grooves 7, 8 on the cam sleeve 3. The actuator 6 is fixed in position. The sliding grooves 7, 8 run along the outer circumferential surface of the cam sleeve 3 in the circumferential direction and the axial direction, so that the cam sleeve 3 during rotation is displaced along the sliding grooves 7, 8. Here, the sliding grooves 7, 8 extend on the cam sleeve 3 in such a manner that the two axial sections 10, 11 are displaced separately from one another and consecutively in the axial direction, namely in each case when the cams 5 are not in a position in the circumferential direction in which they are in valve engagement.

FIG. 1 shows the axial sections 10, 11 lying against one another. FIG. 2 shows the state in which the cam sleeve is rotated by 180° and the axial section 10 is axially displaced, wherein the axial section 11 however is still in its starting position. When the cam sleeve 3 rotates further by 180°, the axial section 11 tracks the first axial section 10 in the arrow direction and both axial sections 10, 11, axially displaced, again lie against one another. Here, the first actuator pin 12 is inserted in the first sliding groove 7 for the axial displacement in an axial direction, the second actuator pin 13 in the second sliding groove 8 for the axial displacement in the axial opposite direction. The control takes place for example via the engine control unit. For the sake of clarity, the actuator 6 has been omitted in FIG. 2.

Figure 3:
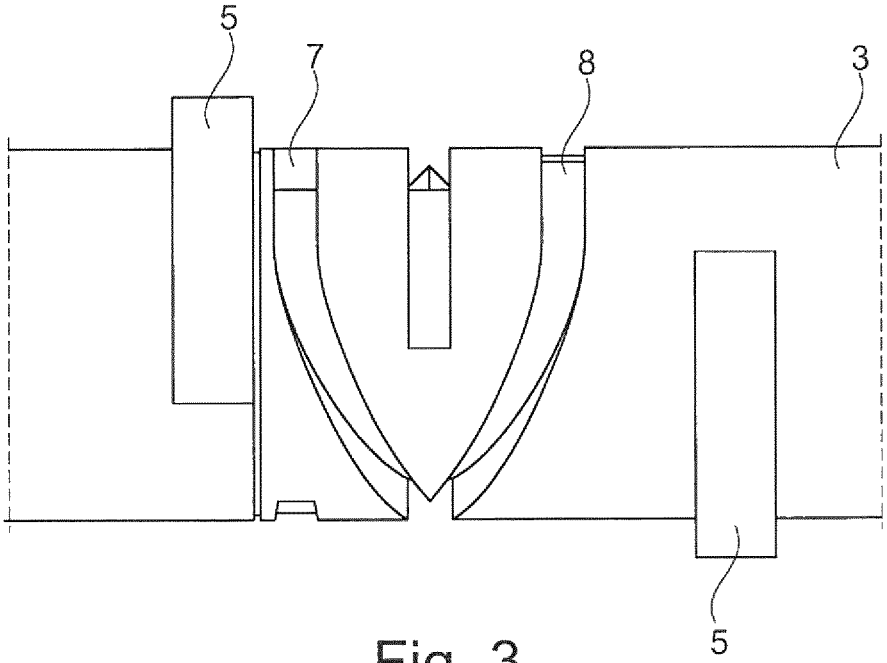
FIG. 3 is a detail view of the sliding grooves on the cam sleeve.

FIG. 3 shows the design and courses of the sliding grooves 7, 8 in more detail, which in a lateral view have a kind of Y-contour in order to make possible the axial displacement during the rotation. The sliding grooves 7, 8 have a tapering cross section directed towards their base with oblique radial contact surfaces, against which the actuator pins 12, 13 can lie flat and without clearance.

Figure 4:
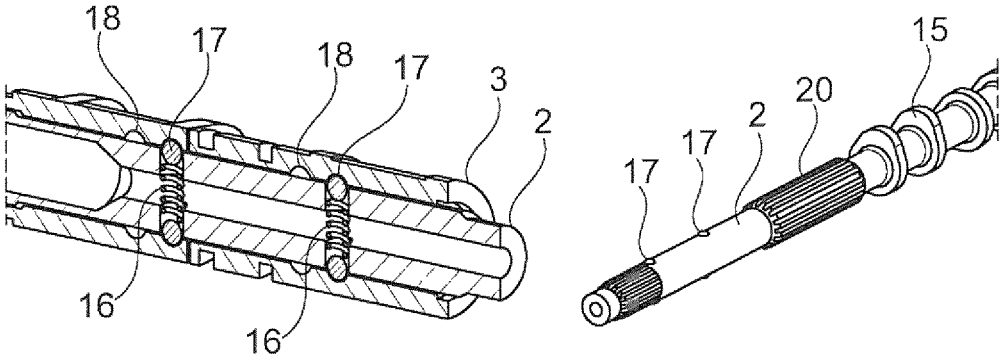
FIG. 4 is a sectional view of the coaxial connection of camshaft and cam sleeve and a perspective view of the camshaft.

FIG. 4 shows a sectional view of the coaxial connection of camshaft 2 and cam sleeve 3 and a perspective view of the camshaft 2. On the camshaft 2 there are splines 20 for coaxially fixing the cam sleeve 3 with a degree of freedom in the axial direction. In addition, the cams 15 for the regular valve operation, which is not switchable via the cam sleeve 3, are evident on the camshaft 2. The camshaft 2 has an axial end stop which delimits the axial moveability of the two axial sections 10, 11. The same is formed by locking balls 17 which are arranged between the camshaft 2 and the two axial sections 10, 11 and preloaded in the radial direction via springs 16, which in each case engage in an inner circulation grooves 18 provided on radial inner surfaces of the two axial sections 10, 11 of the cam sleeve 3. By way of the end stop, sliding of the cam sleeve 3 off the camshaft 2 is prevented. The preload force however is such that the axial sections 10, 11 are again displaceable out of the stop position.

The invention does not limit itself to the preferred exemplary embodiments stated above. On the contrary, a number of versions are contemplated which utilize the shown solution even with embodiments that are of a fundamentally different type. For example, the use of the invention is not limited to six-cylinder in-line engines but is also applicable to other cylinder construction types arranged in series.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A valve control of an internal combustion engine, comprising:

a camshaft; and a cam sleeve which surrounds the camshaft and is fastened in an axially displaceable manner, wherein the cam sleeve has cams associated with individual valves and extending in a radial direction, the cam sleeve, during rotation, is displaceable relative to the camshaft in an axial direction by an actuator, and the cam sleeve comprises at least two axial sections, which are displaceable relative to one another in the axial direction via the actuator engaging in the axial sections, such that cylinders of the internal combustion engine corresponding to the individual valves are deactivated by way of axial displacement of the at least two axial sections of the cam sleeve.

2. The valve control according to claim 1, wherein the at least two axial sections of the cam sleeve are displaceable relative to one another in the axial direction during engagement of the actuator by rotation of the cam sleeve.

3. The valve control according to claim 2, wherein during the rotation of the cam sleeve over a predetermined angle by the actuator, a first axial section is initially displaceable in an axial direction, and upon a continuation of the rotation over a further predetermined angle, a second axial section is subsequently displaceable in the same axial direction until the first and second axial sections, axially displaced, again lie against one another.

4. The valve control according to claim 1, wherein in an outer circumferential surface of the at least two axial sections of the cam sleeve, at least two sliding grooves extending in the circumferential direction and in the axial direction, run in each case, in which the actuator engages.

5. The valve control according to claim 3, wherein in an outer circumferential surface of the at least two axial sections of the cam sleeve, at least two sliding grooves extending in the circumferential direction and in the axial direction, run in each case, in which the actuator engages.

6. The valve control according to claim 4, wherein the sliding grooves of the axial sections merge into one another at a transitional position of the axial sections, and the transitional position is determined by an axial relative position of the axial sections on the camshaft relative to one another.

7. The valve control according to claim 6, wherein the actuator comprises at least one first actuator pin, which engages in the first sliding groove of the axial sections of the cam sleeve and consecutively displaces the axial sections in a first axial direction upon a rotation of the cam sleeve.

8. The valve control according to claim 4, wherein the actuator comprises at least one first actuator pin, which engages in the first sliding groove of the axial sections of the cam sleeve and consecutively displaces the axial sections in a first axial direction upon a rotation of the cam sleeve.

9. The valve control according to claim 7, wherein the actuator comprises at least one second actuator pin, which engages in the second sliding groove of the axial sections of the cam sleeve and consecutively displaces the axial sections in a second axial direction upon a counter-rotation of the cam sleeve.

10. The valve control according to claim 8, wherein the actuator comprises at least one second actuator pin, which engages in the second sliding groove of the axial sections of the cam sleeve and consecutively displaces the axial sections in a second axial direction upon a counter-rotation of the cam sleeve.

11. The valve control according to claim 10, wherein the actuator pins are arranged fixed in position on the actuator and the axial sections are displaceable in the axial direction relative to the actuator.

12. The valve control according to claim 9, wherein the actuator pins are arranged fixed in position on the actuator and the axial sections are displaceable in the axial direction relative to the actuator.

13. The valve control according to claim 4, wherein the first axial section, upon a rotation of the cam sleeve by 180°, is axially displaceable by the actuator and the second axial section, upon a rotation of the cam sleeve by a further 180°, is subsequently axially displaceable in the same direction by the actuator.

14. The valve control according to claim 11, wherein the first axial section, upon a rotation of the cam sleeve by 180°, is axially displaceable by the actuator and the second axial section, upon a rotation of the cam sleeve by a further 180°, is subsequently axially displaceable in the same direction by the actuator.

15. The valve control according to claim 14, wherein the sliding grooves have a tapering cross section with oblique radial contact surfaces, against which the actuator pins of the actuator lie in a flat manner.

16. The valve control according to claim 4, wherein the sliding grooves have a tapering cross section with oblique radial contact surfaces, against which actuator pins of the actuator lie in a flat manner.

17. The valve control according to claim 1, wherein the camshaft has an axial end stop which delimits the axial moveability of the at least two axial sections.

18. The valve control according to claim 17, wherein the axial end stop is formed by retaining devices arranged between the camshaft and the at least two axial sections and preloaded in the radial direction, said retaining devices in each case releasably engage in inner grooves provided on radial inner surfaces of the at least two axial sections.

19. The valve control according to claim 14, wherein the camshaft has an axial end stop which delimits the axial moveability of the at least two axial sections.

20. The valve control according to claim 19, wherein the axial end stop is formed by retaining devices arranged between the camshaft and the at least two axial sections and preloaded in the radial direction, said retaining devices in each case releasably engage in inner grooves provided on radial inner surfaces of the at least two axial sections.

* * * * *